US011226586B1

(12) United States Patent
Onishi et al.

(10) Patent No.: US 11,226,586 B1
(45) Date of Patent: Jan. 18, 2022

(54) IMAGE FORMING APPARATUS AND PROCESSING METHOD

(71) Applicant: TOSHIBA TEC KABUSHIKI KAISHA, Tokyo (JP)

(72) Inventors: Kei Onishi, Sunto Shizuoka (JP); Daisuke Yamashita, Izunokuni Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/030,651

(22) Filed: Sep. 24, 2020

(51) Int. Cl.
*G03G 15/08* (2006.01)
*G03G 21/20* (2006.01)

(52) U.S. Cl.
CPC ..... *G03G 21/203* (2013.01); *G03G 15/0863* (2013.01)

(58) Field of Classification Search
CPC ..... G03G 21/203
See application file for complete search history.

(56) References Cited

U.S. PATENT DOCUMENTS 6,324,354 B1 11/2001 Tode et al.
2006/0029405 A1* 2/2006 Tanaka ..... G03G 15/553 399/27
2008/0008485 A1* 1/2008 Morikawa ..... G03G 15/5041 399/49
2011/0293300 A1* 12/2011 Tanaka ..... G03G 21/20 399/44
2012/0045234 A1* 2/2012 Suzuki ..... G03G 15/5058 399/49
2013/0129389 A1* 5/2013 Moon ..... G03G 21/1676 399/258
2013/0251387 A1* 9/2013 Tanaka ..... G03G 15/09 399/44
2015/0277288 A1* 10/2015 Murayama ..... G03G 15/0889 399/44
2020/0174402 A1* 6/2020 Meguro ..... G03G 15/161

* cited by examiner

*Primary Examiner* — Sevan A Aydin
(74) *Attorney, Agent, or Firm* — Amin, Turocy & Watson, LLP

(57) ABSTRACT

According to one embodiment, an image forming apparatus includes a developing device, an environment sensor, a memory, and a processor. The developing device stores a developer containing a toner and a carrier. The environment sensor measures an environment parameter. The memory stores end time environment information indicating an environment parameter of a date and time when printing is ended. The processor discharges the toner stored in the developing device when a difference between the environment parameter indicated by the end time environment information and the environment parameter measured by the environment sensor exceeds a predetermined threshold value, and puts the toner into the developing device.

20 Claims, 5 Drawing Sheets

IMAGE FORMING APPARATUS AND PROCESSING METHOD

FIELD

Embodiments described herein relate generally to an image forming apparatus and a processing method.

BACKGROUND

An image forming apparatus using a toner prints a test pattern with the toner on a transfer belt. Such an image forming apparatus measures a density of the test pattern and adjusts a charging grid bias or a developing bias.

However, when an environment parameter such as humidity significantly changes, a charge amount of the toner contained in a developer may change. As a result, there is a possibility that the image forming apparatus cannot obtain appropriate image quality.

DETAILED DESCRIPTION

In order to solve the above-described problem, provided are an image forming apparatus and a processing method in which appropriate image quality can be obtained even though an environment parameter changes.

In general, according to an embodiment, an image forming apparatus includes a developing device, an environment sensor, a memory, and a processor. The developing device stores a developer containing a toner and a carrier. The environment sensor measures an environment parameter. The memory stores end time environment information indicating an environment parameter of a date and time when printing is ended. The processor discharges the toner stored in the developing device when a difference between the environment parameter indicated by the end time environment information and the environment parameter measured by the environment sensor exceeds a predetermined threshold value, and puts the toner into the developing device.

Hereinafter, embodiments will be described with reference to the drawings.

An image forming apparatus according to the embodiment forms an image on a printing medium such as paper by using a toner. The image forming apparatus forms a toner image on a photosensitive drum with a toner from a toner cartridge. The image forming apparatus transfers the toner image from the photosensitive drum to a transfer belt. The image forming apparatus transfers the toner image from the transfer belt to the printing medium. The image forming apparatus fixes the toner image on the printing medium by heating the printing medium to which the toner image is transferred with a fixing device.

For example, the image forming apparatus is a printer or a copy machine.

Figure 1:
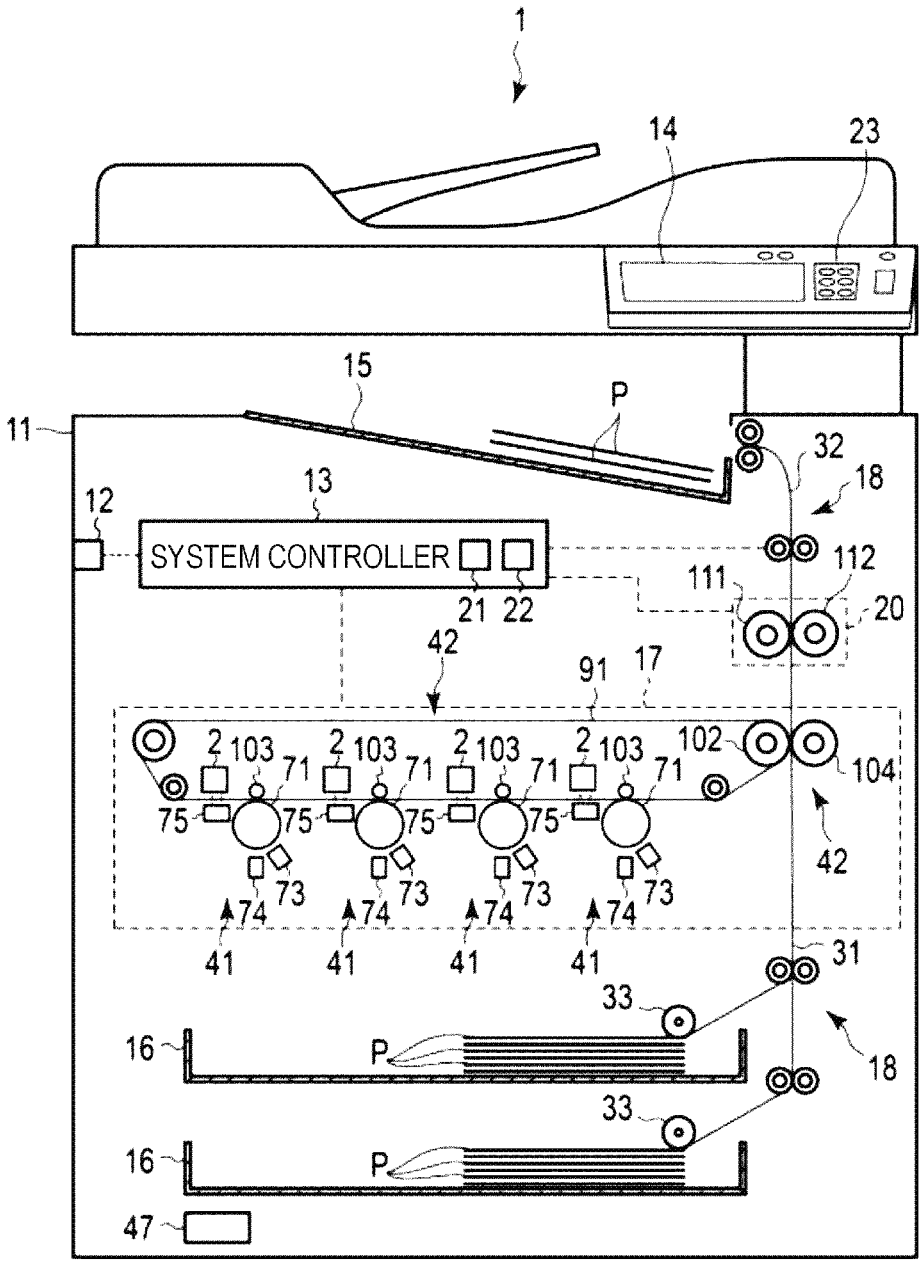
FIG. 1 is a diagram conceptually illustrating a configuration example of an image forming apparatus according to an embodiment.

FIG. 1 conceptually illustrates a configuration example of an image forming apparatus 1 according to the embodiment.

The image forming apparatus 1 is, for example, a multifunction printer (MFP) that performs various processing such as image formation while conveying the printing medium such as paper. For example, the image forming apparatus 1 is a solid-state scanning type printer (for example, an LED printer) that scans an LED array that performs various processing such as the image formation while conveying the printing medium.

For example, the image forming apparatus 1 is configured to receive a toner from a toner cartridge 2 and form an image on the printing medium by the received toner. The toner may be a monochromatic toner, or may be a color toner including colors such as cyan, magenta, yellow, and black.

As illustrated in FIG. 1, the image forming apparatus 1 includes a housing 11, a communication interface 12, a system controller 13, a display unit 14, an operation interface 23, a plurality of paper trays 16, a paper discharging tray 15, a conveying unit 18, an image forming unit 17, a fixing device 20, and an environment sensor 47.

The housing 11 forms an outer shape of the image forming apparatus 1. The housing 11 accommodates the communication interface 12, the system controller 13, the display unit 14, the operation interface 23, the plurality of paper trays 16, the paper discharging tray 15, the conveying unit 18, the image forming unit 17, the fixing device 20, and the environment sensor 47.

The communication interface 12 is an interface for communicating with other devices. For example, the communication interface 12 is used for communication with a host apparatus (external device). For example, the communication interface 12 is configured as a local area network (LAN) connector. The communication interface 12 may be the one that performs wireless communication with other devices according to a standard such as Bluetooth (registered trademark) or Wi-fi (registered trademark).

The system controller 13 controls the image forming apparatus 1. The system controller 13 includes a processor 21 and a memory 22.

The processor 21 is an arithmetic element that executes arithmetic processing. For example, the processor 21 is a CPU. The processor 21 performs various processing based upon data such as a program stored in the memory 22. The processor 21 functions as a control unit that can execute various operations by executing the program stored in the memory 22.

The memory 22 is a storage medium that stores a program and data used by the program. The memory 22 also functions as a working memory. That is, the memory 22 temporarily stores the data being processed by the processor 21 and the program to be executed by the processor 21.

The memory 22 also stores end time information and end time environment information.

The end time information indicates a date and time when a last printing operation is ended. For example, the end time information indicates the date and time when the printing operation for forming the image on the printing medium by using the toner, such as a copy operation or a printing operation, is ended.

The end time environment information indicates an environment parameter at the time when the last printing operation is ended. The environment parameter is related to a surrounding environment of the housing 11. Here, the environment parameter is humidity. The environment parameter may be a temperature. A content of the environment parameter is not limited to a specific configuration.

The processor 21 executes various information processing by executing the program stored in the memory 22. For example, the processor 21 generates a printing job, for example, based upon an image acquired from the external device via the communication interface 12. The processor 21 stores the generated printing job in the memory 22.

The printing job includes image data indicating the image formed on the printing medium P. The image data may be data for forming the image on one printing medium P, or may be data for forming the image on a plurality of printing media P. The printing job includes information indicating whether to perform color printing or monochrome printing.

The processor 21 executes the program stored in the memory 22, thereby functioning as a controller (engine controller) that controls operations of the conveying unit 18, the image forming unit 17, and the fixing device 20. That is, the processor 21 controls conveyance of the printing medium P by the conveying unit 18, image formation on the printing medium P by the image forming unit 17, and fixing of the image on the printing medium P by the fixing device 20.

The image forming apparatus 1 may be configured to include the engine controller separately from the system controller 13. In this case, the engine controller controls the conveyance of the printing medium P by the conveying unit 18, the image formation on the printing medium P by the image forming unit 17, and the fixing of the image on the printing medium P by the fixing device 20. In this case, the system controller 13 also supplies information necessary for controlling the engine controller to the engine controller.

The display unit 14 includes a display that displays a screen according to a video signal inputted from the system controller 13 or a display control unit such as a graphic controller which is not illustrated. For example, the display unit 14 displays the screen for various settings of the image forming apparatus 1 under the control of the system controller 13.

The operation interface 23 is connected to an operation member which is not illustrated. The operation interface 23 supplies an operation signal in response to an operation of the operation member to the system controller 13. The operation member is, for example, a touch sensor, a numeric keypad, a power supply key, a paper feed key, various function keys, or a keyboard. The touch sensor acquires information indicating a designated location in a certain region. The touch sensor is configured as a touch panel integrated with the display unit 14, thereby inputting a signal indicating a touched location on the screen displayed on the display unit 14 to the system controller 13.

The plurality of paper trays 16 are cassettes that respectively store the printing media P. The paper tray 16 has a structure in which the printing medium P can be supplied from the outside of the housing 11. For example, the paper tray 16 has a structure that can be pulled out from the housing 11.

The paper discharging tray 15 is a tray that supports the printing medium P discharged from the image forming apparatus 1. The paper discharging tray 15 is formed in the middle of the housing 11. The paper discharging tray 15 is formed as a part of the housing 11.

The fixing device 20 fixes the toner image by heating the printing medium P to which the toner image is transferred. The fixing device 20 is operated based upon the control of the system controller 13. The fixing device 20 includes a heat roller 111 and a press roller 112.

The heat roller 111 is a fixing rotator that is rotated by a motor which is not illustrated. The heat roller 111 includes a metallic core bar formed in a hollow shape and an elastic layer formed on an outer periphery of the core bar. The heat roller 111 is heated to a high temperature by a heater arranged inside the core bar formed in the hollow shape. The heater is, for example, a halogen heater. The heater may be an induction heating (IH) heater that heats the core bar by electromagnetic induction.

The press roller 112 is provided at a location facing the heat roller 111. The press roller 112 includes a core bar formed of metal with a predetermined outer diameter, and an elastic layer formed on an outer periphery of the core bar. The press roller 112 applies pressure to the heat roller 111 by stress applied from a tension member which is not illustrated. The pressure is applied from the press roller 112 to the heat roller 111, thereby forming a nip (fixing nip) in which the press roller 112 and the heat roller 111 are in close contact with each other. The press roller 112 rotates by a motor which is not illustrated. The press roller 112 rotates, thereby moving the printing medium P entering the fixing nip and pressing the printing medium P against the heat roller 111.

According to the above-described configuration, the heat roller 111 and the press roller 112 apply heat and pressure to the printing medium P passing through the fixing nip. As a result, the toner image is fixed on the printing medium P passing through the fixing nip.

The environment sensor 47 measures an environment parameter around the housing 11. Here, the environment sensor 47 measures humidity of the atmosphere around the housing 11 as the environment parameter. The environment sensor 47 transmits a sensor signal indicating the measured humidity to the system controller 13.

The environment sensor 47 is installed at a location apart from a member that affects the environment parameter such as the fixing device 20. Here, the environment sensor 47 is installed near the paper tray 16.

Next, a configuration of conveying the printing medium P of the image forming apparatus 1 will be described.

The conveying unit 18 is a mechanism that conveys the printing medium P in the image forming apparatus 1. As illustrated in FIG. 1, the conveying unit 18 includes a plurality of conveyance paths. For example, the conveying unit 18 includes a paper feeding conveyance path 31 and a paper discharging conveyance path 32.

The paper feeding conveyance path 31 and the paper discharging conveyance path 32 are respectively formed of a plurality of motors, a plurality of rollers, and a plurality of guides, which are not illustrated. Based upon the control of the system controller 13, the plurality of motors rotate a shaft, thereby rotating a roller interlocked with the rotation of the shaft. The plurality of rollers move the printing medium P by the rotation thereof. The plurality of guides control a conveyance direction of the printing medium P.

The paper feeding conveyance path 31 picks up the printing medium P from the paper tray 16 and supplies the picked-up printing medium P to the image forming unit 17. The paper feeding conveyance path 31 includes a pickup roller 33 corresponding to each paper tray. The respective pickup rollers 33 respectively pick up the printing medium P of the paper tray 16 into the paper feeding conveyance path 31.

The paper discharging conveyance path 32 is a conveyance path for discharging the printing medium P on which the image is formed from the image forming unit 17 to the outside of the housing 11. The printing medium P discharged by the paper discharging conveyance path 32 is supported by the paper discharging tray 15.

Next, the image forming unit 17 will be described.

The image forming unit 17 is configured to form an image on the printing medium P. Specifically, the image forming unit 17 forms the image on the printing medium P based upon the printing job generated by the processor 21.

The image forming unit 17 includes a plurality of process units 41 and a transfer mechanism 42.

Figure 2:
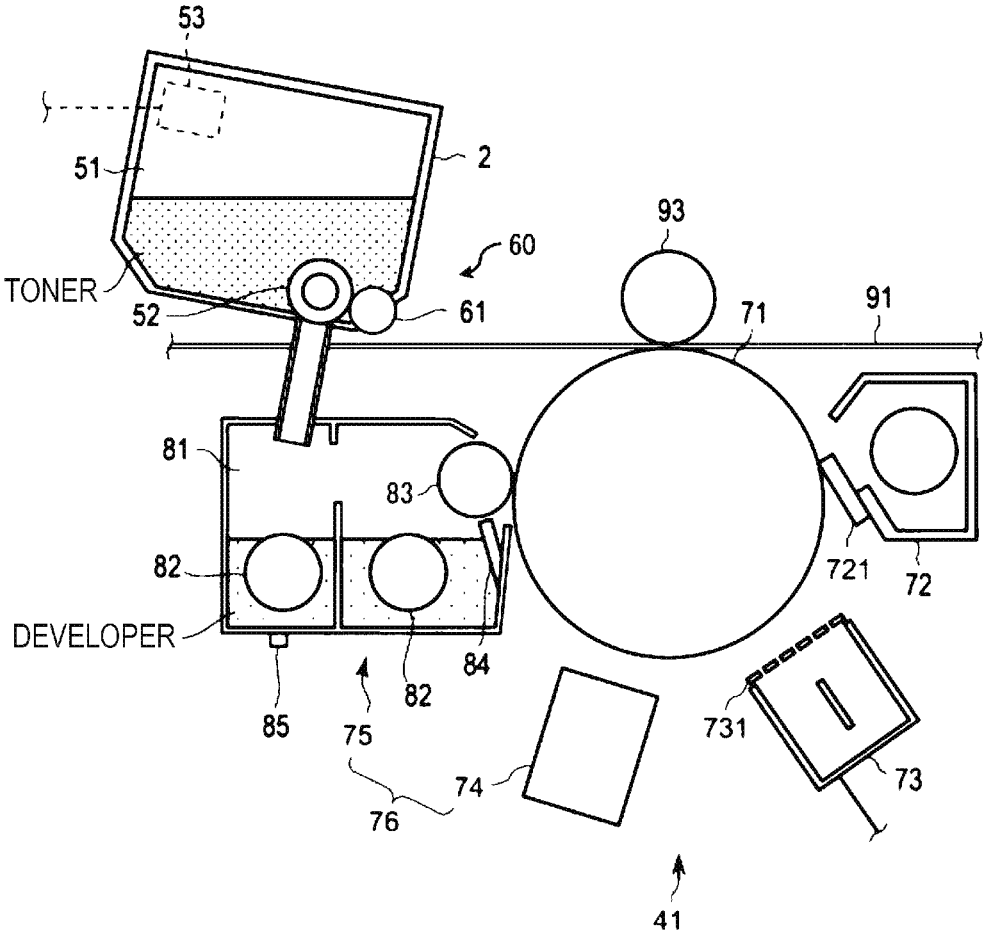
FIG. 2 is a diagram conceptually illustrating a configuration example of a process unit.

FIG. 2 is an explanatory diagram illustrating an example of a part of the configuration of the image forming unit 17. The plurality of toner cartridges 2 and the plurality of process units 41 respectively have the same configuration. Therefore, in FIG. 2, one toner cartridge 2 and one process unit 41 are shown as an example.

First, the toner cartridge 2 will be described. As illustrated in FIG. 2, the toner cartridge 2 includes a toner-containing container 51, a toner sending-out mechanism 52, and a memory 53.

The toner-containing container 51 is a container that contains a toner. The toner sending-out mechanism 52 is a mechanism for sending out the toner in the toner-containing container 51. The toner sending-out mechanism 52 is, for example, a screw provided in the toner-containing container 51. By rotating the screw, the toner in the toner-containing container 51 is sent out.

The toner-containing container 51 is loaded in a loading unit 60 (mounting member). The loading unit 60 is a module on which the toner cartridge 2 filled with the toner is mounted. The loading unit 60 includes a toner replenishment motor 61. The loading unit 60 also includes a communication interface that connects the memory 53 of the toner cartridge 2 and the system controller 13.

When the toner cartridge 2 is loaded in the loading unit 60, the toner replenishment motor 61 is connected to the toner sending-out mechanism 52 of the toner cartridge 2. The toner replenishment motor 61 drives the toner sending-out mechanism 52 based upon the control of the system controller 13. The toner replenishment motor 61 drives the toner sending-out mechanism 52, thereby supplying the toner in the toner-containing container 51 to a developing device 75 which will be described later.

Next, the process unit 41 will be described. As illustrated in FIG. 2, the process unit 41 includes a photosensitive drum 71, a cleaner 72, a charging unit 73, an exposure device 74, and a developing device 75.

The photosensitive drum 71 is a photoreceptor including a cylindrical drum and a photosensitive layer formed on an outer peripheral surface of the drum. The photosensitive drum 71 rotates at a constant speed by power transmitted from a driving mechanism.

The cleaner 72 includes a blade 721 that contacts a surface of the photosensitive drum 71. The cleaner 72 uses the blade 721 to remove the toner remaining on the surface of the photosensitive drum 71.

The charging unit 73 is an apparatus that uniformly charges the surface of the photosensitive drum 71. For example, the charging unit 73 applies a grid bias voltage outputted from a grid electrode 731 to the photosensitive drum 71, thereby charging the photosensitive drum 71 to a uniform negative polarity potential. Such a charging unit 73 is also referred to as a charging charger.

The exposure device 74 includes a plurality of light emitting elements. The light emitting element is, for example, a laser diode (LD), a light emitting diode (LED), or an organic EL (OLED). The plurality of light emitting elements are arranged in a main scanning direction which is a direction parallel to a rotation axis of the photosensitive drum 71. Each light emitting element is configured to irradiate one point on the photosensitive drum 71 with light.

The exposure device 74 forms a latent image for one line on the photosensitive drum 71 by irradiating the surface of the charged photosensitive drum 71 with light from the plurality of light emitting elements arranged in the main scanning direction. The exposure device 74 also forms latent images for a plurality of lines by continuously irradiating the rotating photosensitive drum 71 with light.

The developing device 75 is an apparatus that causes the toner to adhere to the photosensitive drum 71. The developing device 75 includes a developer container 81, a stirring mechanism 82, a developing roller 83, a doctor blade 84, and an automatic toner control (ATC) sensor 85.

The developer container 81 is a container for containing a developer containing a toner and a carrier. The developer container 81 receives the toner sent out by the toner sending-out mechanism 52 from the toner cartridge 2. The carrier is contained in the developer container 81 when the developing device 75 is manufactured.

The stirring mechanism 82 is located inside the developer container 81. The stirring mechanism 82 stirs the toner and the carrier in the developer container 81.

The developing roller 83 rotates in the developer container 81, thereby causing the developer to adhere to a surface of the developing roller 83.

The doctor blade 84 is a member arranged at a predetermined distance from the surface of the developing roller 83. The doctor blade 84 removes a part of the developer adhering to the surface of the rotating developing roller 83. As a result, a developer layer having a thickness corresponding to a distance between the doctor blade 84 and the surface of the developing roller 83 is formed on the surface of the developing roller 83.

The ATC sensor 85 (density sensor) is, for example, a magnetic flux sensor including a coil and detecting a voltage value generated in the coil. The detected voltage of the ATC sensor 85 changes depending on the density of a magnetic flux from the toner in the developer container 81. That is, the ATC sensor 85 detects a voltage in accordance with a density ratio of the toner to the carrier in the developer container 81. Such a density ratio is referred to as a toner density. The system controller 13 can determine the toner density in the developer container 81 based upon the detected voltage of the ATC sensor 85.

As described above, when the exposure device 74 irradiates the surface of the photosensitive drum 71 charged by the charging unit 73 with the light, the latent image is formed. After that, when the layer of the developer formed on the surface of the developing roller 83 in the developing device 75 approaches the surface of the photosensitive drum 71, the toner contained in the developer adheres to the latent image formed on the surface of the photosensitive drum 71. As a result, the toner image is formed on the surface of the photosensitive drum 71. That is, the exposure device 74 and the developing device 75 form an image forming unit 76.

Next, the transfer mechanism 42 will be described.

The transfer mechanism 42 is configured to transfer the toner image formed on the surface of the photosensitive drum 71 to the printing medium P.

As illustrated in FIGS. 1 and 2, the transfer mechanism 42 includes, for example, a primary transfer belt 91, a secondary transfer counter roller 102, a plurality of primary transfer rollers 103, and a secondary transfer roller 104.

The primary transfer belt 91 is an endless belt wound around the secondary transfer counter roller 102 and a plurality of winding rollers. An inner surface (inner peripheral surface) of the primary transfer belt 91 contacts the secondary transfer counter roller 102 and the plurality of winding rollers, and an outer surface (outer peripheral surface) thereof faces the photosensitive drum 71 of the process unit 41.

The secondary transfer counter roller 102 is rotated by a motor which is not illustrated. The secondary transfer counter roller 102 conveys the primary transfer belt 91 in a predetermined conveying direction by the rotation thereof. The plurality of winding rollers are configured to be freely rotatable. The plurality of winding rollers rotate according to movement of the primary transfer belt 91 by the secondary transfer counter roller 102.

The plurality of primary transfer rollers 103 causes the primary transfer belt 91 to contact the photosensitive drum 71 of the process unit 41. The plurality of primary transfer rollers 103 are provided so as to correspond to the photosensitive drums 71 of the plurality of process units 41. Specifically, the plurality of primary transfer rollers 103 are provided at locations respectively facing the photosensitive drums 71 of the corresponding process units 41 in a location where the primary transfer belt 91 is interposed therebetween. The primary transfer roller 103 contacts the inner peripheral surface side of the primary transfer belt 91 and displaces the primary transfer belt 91 to the side of the photosensitive drum 71. As a result, the primary transfer roller 103 causes the outer peripheral surface of the primary transfer belt 91 to contact the photosensitive drum 71.

The secondary transfer roller 104 is provided at a location facing the secondary transfer counter roller 102. The secondary transfer roller 104 contacts the outer peripheral surface of the primary transfer belt 91 and applies pressure thereto. As a result, a transfer nip in which the secondary transfer roller 104 and the outer peripheral surface of the primary transfer belt 91 are in close contact with each other is formed. When the printing medium P passes through the transfer nip, the secondary transfer roller 104 presses the printing medium P passing through the transfer nip against the outer peripheral surface of the primary transfer belt 91.

By the rotation of the secondary transfer roller 104 and the secondary transfer counter roller 102, the secondary transfer roller 104 and the secondary transfer counter roller 102 convey the printing medium P supplied from the paper feeding conveyance path 31 in a state where the printing medium P is interposed therebetween. As a result, the printing medium P passes through the transfer nip.

In the above-described configuration, when the outer peripheral surface of the primary transfer belt 91 contacts the photosensitive drum 71, the toner image formed on the surface of the photosensitive drum is transferred to the outer peripheral surface of the primary transfer belt 91. As illustrated in FIG. 1, when the image forming unit 17 includes the plurality of process units 41, the primary transfer belt 91 receives the toner image from the photosensitive drums 71 of the plurality of process units 41. The toner image transferred to the outer peripheral surface of the primary transfer belt 91 is conveyed, by the primary transfer belt 91, up to the transfer nip where the secondary transfer roller 104 and the outer peripheral surface of the primary transfer belt 91 are in close contact with each other. When the printing medium P exists in the transfer nip, the toner image transferred to the outer peripheral surface of the primary transfer belt 91 is transferred to the printing medium P at the transfer nip.

Next, a function to be realized by the image forming apparatus 1 will be described. The function to be realized by the image forming apparatus 1 is realized when the processor 21 executes the program stored in the memory 22.

First, the processor 21 has a function of determining whether a difference between humidity at the time of printing reception and humidity indicated by the end time environment information exceeds a predetermined threshold value.

The processor 21 generates a printing job based upon a signal from the communication interface 12 or the operation interface 23. When the printing job is generated, the processor 21 acquires a current date and time as a printing reception date and time. When acquiring the printing reception date and time, the processor 21 determines whether a difference between a date and time indicated by the end time information and the printing reception date and time exceeds a predetermined threshold value (time threshold value, for example, from several weeks to several months). That is, the processor 21 determines whether a predetermined period elapses after the time when the last printing is ended.

When determining that the difference therebetween exceeds the time threshold value, the processor 21 uses the environment sensor 47 to acquire current humidity as the humidity at the time of printing reception. When acquiring the humidity at the time of printing reception, the processor 21 determines whether the difference between the humidity at the time of printing reception and the humidity indicated by the end time environment information exceeds a predetermined threshold value (environment threshold value). That is, the processor 21 determines whether the difference between the humidity at the time of printing reception and the humidity at the time of finishing the last printing exceeds the environment threshold value.

When determining that the difference between the date and time indicated by the end time information and the printing reception date and time does not exceed the environment threshold value, the processor 21 performs a printing operation based upon the generated printing job.

The processor 21 has a function of replacing the toner stored in the developing device 75 when the difference between the humidity at the time of printing reception and the humidity indicated by the end time environment information exceeds the environment threshold value.

When the difference between the humidity at the time of printing reception and the humidity indicated by the end time environment information exceeds the environment threshold value, the processor 21 controls the exposure device 74 to charge the photosensitive drum 71. Here, an electrostatic latent image formed on the photosensitive drum 71 is a pattern for discharging the toner (replacement pattern).

When the photosensitive drum 71 is charged, the processor 21 rotates the developing roller 83 and causes the developer to adhere to the developing roller 83. The processor 21 continues to rotate the developing roller 83 and causes the toner of the developer adhering to the developing roller 83 to adhere to the photosensitive drum 71. As a result, the toner image of the replacement pattern is developed on the photosensitive drum 71.

The carrier remaining on the developing roller 83 is supplied into the developing device 75.

When the toner adheres to the photosensitive drum 71, the processor 21 rotates the photosensitive drum 71 and causes the blade 721 to remove the toner image adhering to the photosensitive drum 71. That is, the processor 21 rotates the photosensitive drum 71 without transferring the toner image adhering to the photosensitive drum 71 to the primary transfer belt 91. In this case, the primary transfer roller 103 may be retreated from the primary transfer belt 91.

The processor 21 may transfer the toner image adhering to the photosensitive drum 71 to the primary transfer belt 91. In this case, the processor 21 may cause the blade for removing the toner image on the primary transfer belt 91 to remove the toner image without transferring the toner from the primary transfer belt 91 to the printing medium P.

A method by which the processor 21 discharges the toner from the developing device 75 is not limited to a specific method.

When the toner is discharged from the developing device 75, the processor 21 measures the toner ratio density in the developing device 75 by using the ATC sensor 85.

Figure 3:
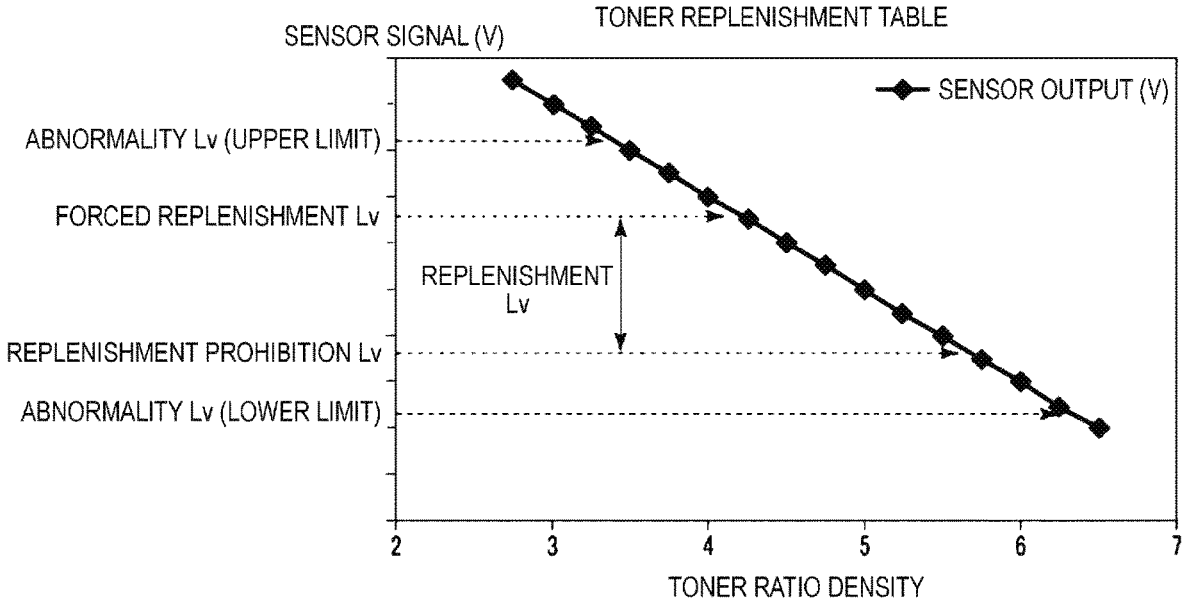
FIG. 3 is a table illustrating a characteristic of a density sensor.

FIG. 3 is a table illustrating a relationship between a sensor signal from the ATC sensor 85 and a toner ratio density. In FIG. 3, a horizontal axis represents the toner ration density (wt %), and a vertical axis represents a sensor output voltage (V).

As illustrated in FIG. 3, the sensor signal indicates a lower toner ratio density as the voltage is higher.

When the voltage of the sensor signal from the ATC sensor 85 is greater than an abnormality Lv (upper limit), or when the voltage of the sensor signal therefrom is smaller than an abnormality Lv (lower limit), the processor 21 displays an error on the display unit 14.

When the voltage of the sensor signal from the ATC sensor 85 falls within a range from forced replenishment Lv to replenishment prohibition Lv, the processor 21 sets a time for putting the toner into the developing device 75 (replenishment time) based upon the voltage of the sensor signal. That is, the processor 21 sets a time for driving the toner replenishment motor 61 as the replenishment time.

Figure 4:
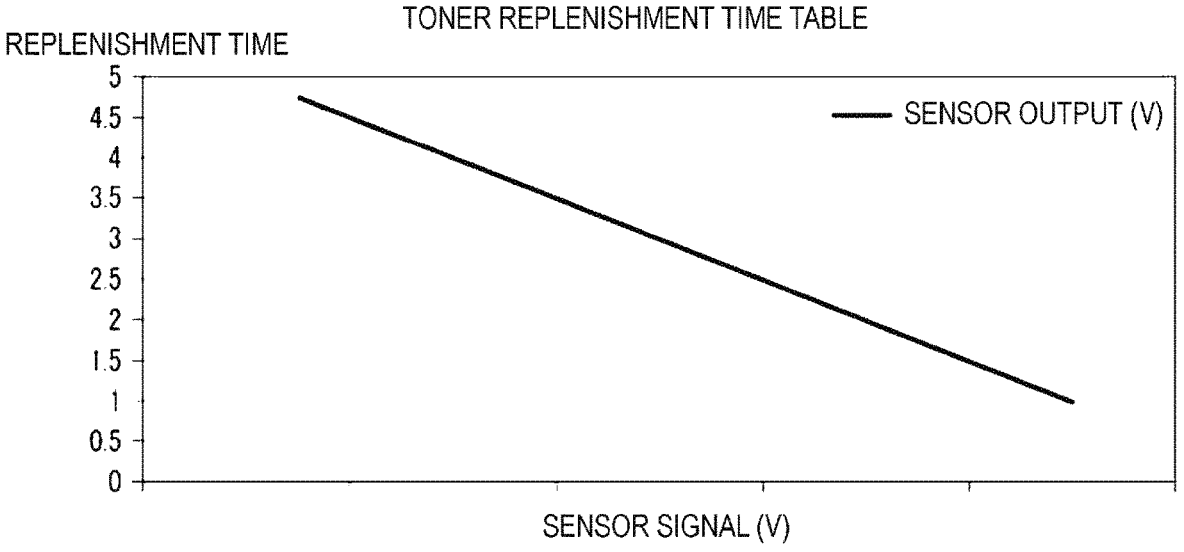
FIG. 4 is a table for setting a replenishment time.

FIG. 4 is a toner replenishment time table illustrating a relationship between the sensor signal from the ATC sensor 85 and the replenishment time. In FIG. 4, a horizontal axis represents a sensor output voltage (V), and a vertical axis represents replenishment time (s).

As illustrated in FIG. 4, as the voltage of the sensor signal is higher, the replenishment time is shorter.

The processor 21 sets the replenishment time corresponding to the sensor signal by referring to the toner replenishment time table.

When setting the replenishment time, the processor 21 puts the toner into the developing device 75 for the set replenishment time. That is, the processor 21 drives the toner replenishment motor 61 for the set replenishment time.

The processor 21 repeats the operation from the discharge of the toner to the replenishment of the toner a plurality of times.

When the voltage of the sensor signal from the ATC sensor 85 exceeds the forced replenishment Lv, the processor 21 forcibly puts the toner into the developing device 75 until the toner ratio density in the developing device 75 reaches a predetermined value (forced replenishment). That is, when the toner ratio density in the developing device 75 is lower than a predetermined threshold value, the processor 21 puts the toner into the developing device 75 until the toner ratio density in the developing device 75 reaches the predetermined value.

For example, the processor 21 drives the toner replenishment motor 61 for a predetermined period, thereby putting the toner into the developing device 75. When the toner is supplied to the developing device 75, the processor 21 measures the toner ratio density by using the ATC sensor 85. When the measured toner ratio density is lower than the predetermined threshold value, the processor 21 drives the toner replenishment motor 61 again for a predetermined period, thereby putting the toner into the developing device 75. The above-described operation is repeated, such that the processor 21 sets the toner ratio density in the developing device 75 to the predetermined value.

The processor 21 has a function of printing the image on the printing medium P according to the printing job when toner is replaced.

When the toner replacement is completed, the processor 21 controls the exposure device 74 and the like based upon the printing job to charge the photosensitive drum 71. Here, the electrostatic latent image formed on the photosensitive drum 71 is a pattern of the image based upon the printing job.

When the photosensitive drum 71 is charged, the processor 21 rotates the developing roller 83 and causes the developer to adhere to the developing roller 83. The processor 21 continues to rotate the developing roller 83 and causes the toner of the developer adhering to the developing roller 83 to adhere to the photosensitive drum 71. As a result, a toner image having the pattern of the image is developed on the photosensitive drum 71. The carrier remaining on the developing roller 83 is supplied into the developing device 75.

When the toner adheres to the photosensitive drum 71, the processor 21 transfers the toner image adhering to the photosensitive drum 71 to the primary transfer belt 91. When transferring the toner image to the primary transfer belt 91, the processor 21 transfers the toner image from the primary transfer belt 91 to the printing medium P by using the secondary transfer roller 104.

When transferring the toner image to the printing medium P, the processor 21 fixes the toner image on the printing medium P by using the fixing device 20. After fixing the toner image on the printing medium P, the processor 21 causes the conveying unit 18 to discharge the printing medium P on which the toner image is fixed to the paper discharging tray 15.

When the difference between the humidity at the time of printing reception and the humidity indicated by the end time environment information does not exceed the predetermined threshold value, the processor 21 performs the printing operation.

When performing the forced replenishment, the processor 21 performs the printing operation.

The processor 21 has a function of updating the end time information and the end time environment information when ending the printing operation.

When ending the printing operation, the processor 21 acquires the date and time when the printing operation is ended (for example, current date and time). When acquiring the date and time when the printing operation is completed, the processor 21 updates the end time information stored in the memory 22 to information indicating the acquired date and time.

When updating the end time information, the processor 21 measures humidity at the time when the printing operation is ended (for example, current humidity) by using the environment sensor 47. When measuring the humidity, the processor 21 updates the end time environment information stored in the memory 22 to information indicating the measured humidity.

Next, an operation example of the image forming apparatus 1 will be described.

Figure 5:
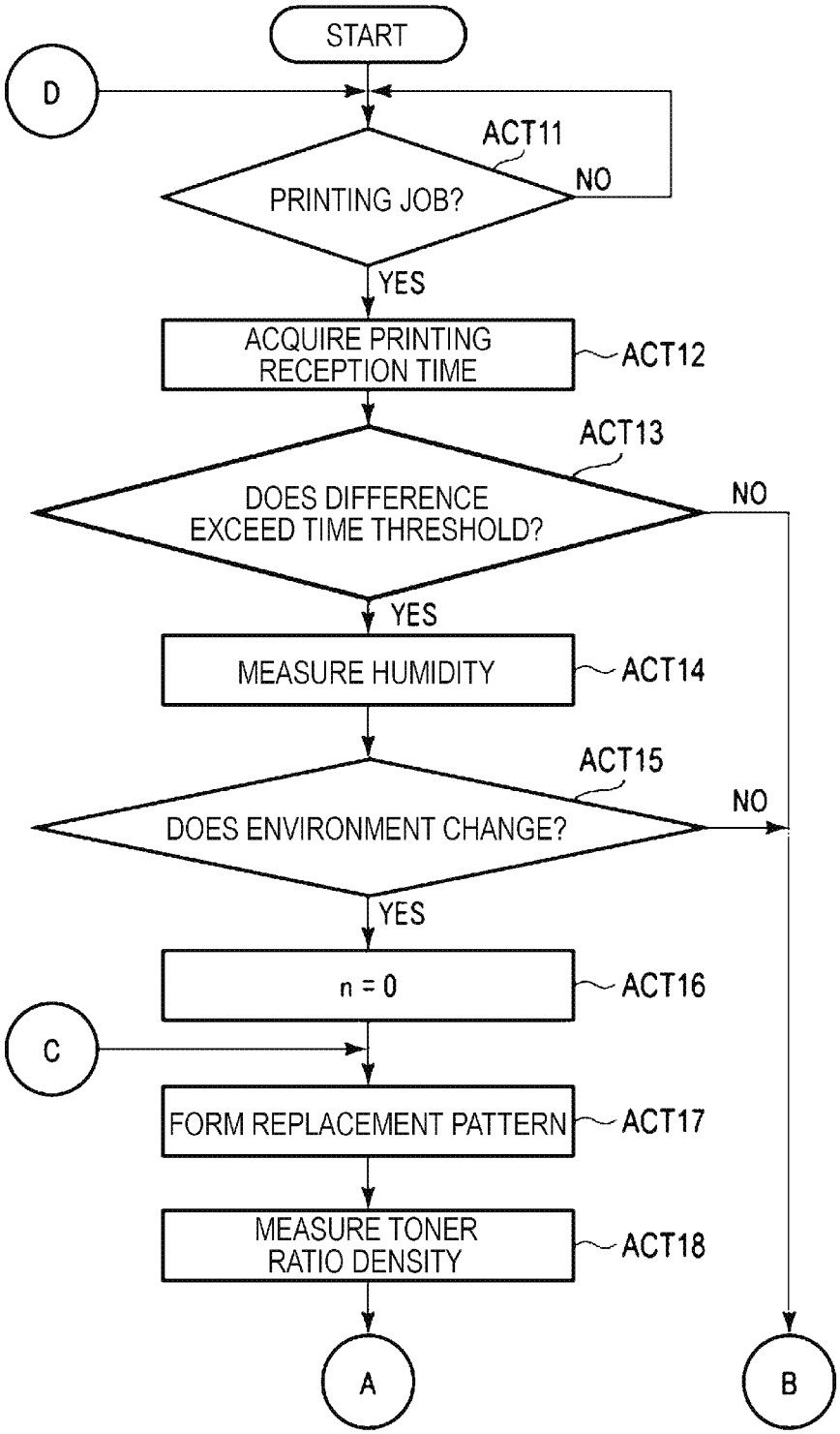
FIG. 5 is a flowchart illustrating an operation example of the image forming apparatus.
Figure 6:
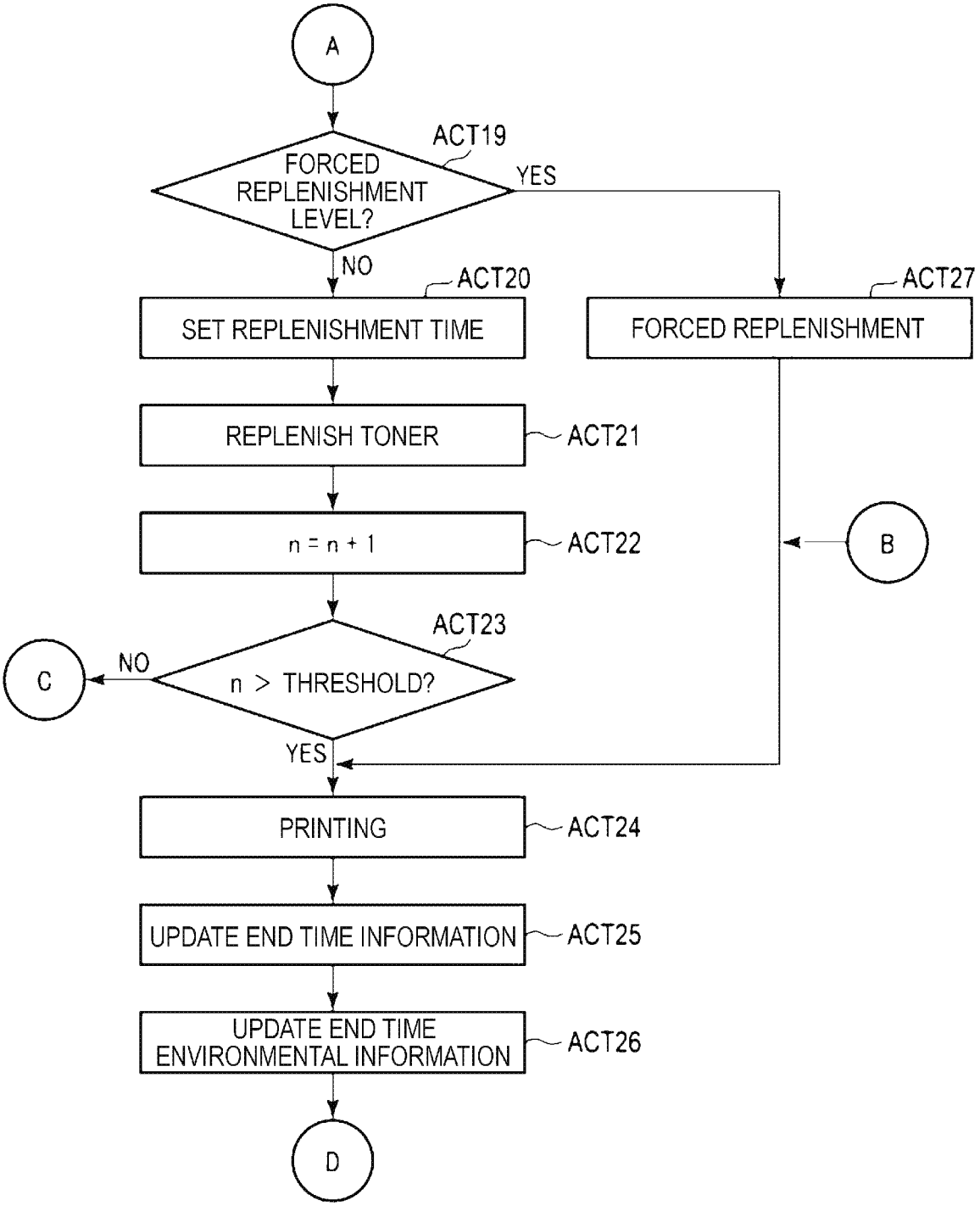
FIG. 6 is a flowchart illustrating an operation example of the image forming apparatus.

FIGS. 5 and 6 are flowcharts illustrating the operation example of the image forming apparatus 1.

First, the processor 21 determines whether a printing job is generated based upon a signal from the communication interface 12 or the operation interface 23 (ACT 11). When determining that the printing job is not generated (ACT 11, NO), the processor 21 returns to ACT 11.

When determining that the printing job is generated (ACT 11, YES), the processor 21 acquires a printing reception date and time (ACT 12). When acquiring the printing reception date and time, the processor 21 determines whether a difference between a date and time indicated by the end time information stored in the memory 22 and the printing reception date and time exceeds a time threshold value (ACT 13).

When determining that the difference therebetween exceeds the time threshold value (ACT 13, YES), the processor 21 measures humidity by using the environment sensor 47 (ACT 14). When measuring the humidity, the processor 21 determines whether a difference between humidity indicated by the end time environment information stored in the memory 22 and the measured humidity exceeds an environment threshold value (ACT 15).

When determining that the difference therebetween exceeds the environment threshold value (ACT 15, YES), the processor 21 resets n that counts the number of times that a replacement pattern is formed (n=0) (ACT 16). When resetting n, the processor 21 discharges a toner from the developing device 75 by forming the replacement pattern on the photosensitive drum 71 (ACT 17).

When discharging the toner therefrom, the processor 21 measures a toner ratio density by using the ATC sensor 85 (ACT 18). When measuring the toner ratio density, the processor 21 determines whether the measured toner ratio density is a forced replenishment level (ACT 19).

When determining that the measured toner ratio density is not the forced replenishment level (ACT 19, NO), the processor 21 sets a replenishment time based upon the toner ratio density (ACT 20). Here, it is assumed that a voltage of a sensor signal from the ATC sensor 85 falls within a range from the forced replenishment Lv to the replenishment prohibition Lv.

When setting the replenishment time, the processor 21 puts the toner into the developing device 75 for the set replenishment time (ACT 21).

When putting the toner into the developing device 75, the processor 21 increments n (adds 1 to n) (ACT 22). When incrementing n, the processor 21 determines whether n exceeds a predetermined threshold value (ACT 23).

When determining that n does not exceed the predetermined threshold value (ACT 23, NO), the processor 21 returns to ACT 17.

When determining that n exceeds the predetermined threshold value (ACT 23, YES), the processor 21 performs a printing operation based upon the printing job (ACT 24). When performing the printing operation, the processor 21 updates the end time information (ACT 25).

When updating the end time information, the processor 21 updates the end time environment information (ACT 26). After updating the end time environment information, the processor 21 returns to ACT 11.

When determining that the measured toner ratio density is the forced replenishment level (ACT 19, YES), the processor performs the forced replenishment (ACT 27). When performing the forced replenishment, the processor 21 proceeds to ACT 24.

When determining that the difference therebetween does not exceed the time threshold value (ACT 13, NO), or when determining that the difference therebetween does not exceed the environment threshold value (ACT 15, NO), the processor 21 proceeds to ACT 24.

When the difference between the humidity indicated by the end time environment information and the acquired humidity exceeds the environment threshold value regardless of the printing reception date and time, the processor 21 may replace the toner in the developing device 75. That is, the processor 21 may not execute ACT 12 and ACT 13.

The processor 21 may execute ACT 25 after executing ACT 26.

The processor 21 may also set a toner replenishment amount based upon the toner ratio density. The processor 21 may drive the toner replenishment motor 61 according to the set replenishment amount.

The image forming apparatus 1 may also perform monochrome printing. That is, the image forming apparatus 1 may include one process unit 41.

The image forming apparatus configured as described above measures the humidity as the environment parameter before starting the printing operation. The image forming apparatus replaces the toner in the developing device when the difference between the humidity at the time of finishing the last printing and the measured humidity exceeds the predetermined threshold value. As a result, the image forming apparatus can control a charge amount by replacing the toner even though the charge amount of the toner in the developer fluctuates due to a change in the environment. As a result, the image forming apparatus can obtain appropriate image quality.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a developing device that stores a developer containing a toner and a carrier;

an environment sensor that measures a first environment parameter;

a memory that stores end time environment information indicating a second environment parameter of a date and a time when printing ends; and a processor that discharges the toner stored in the developing device when a difference between the second environment parameter indicated by the end time environment information stored in the memory at end of a last printing and the first environment parameter measured by the environment sensor at a current printing exceeds a predetermined threshold value, and that puts the toner into the developing device.

2. The image forming apparatus according to claim 1, wherein the memory stores end time information indicating the date and time when the printing ends, and the processor discharges the toner stored in the developing device when a difference between the date and time indicated by the end time information and a printing reception date and time exceeds a time threshold value, and when the difference between the second environment parameter indicated by the end time environment information and the first environment parameter measured by the environment sensor exceeds an environment threshold value, and puts the toner into the developing device.

3. The image forming apparatus according to claim 2, wherein when ending a printing operation, the processor updates the end time information based upon a data and time when the printing operation is completed.

4. The image forming apparatus according to claim 1, further comprising:

a mounting member that mounts a toner cartridge that stores the toner;

a photosensitive drum to which the toner of the developer adheres; and a blade that removes the toner adhering to the photosensitive drum, wherein the processor discharges the toner from the developing device by forming a toner image on the photosensitive drum with the toner of the developing device, and puts the toner from the toner cartridge into the developing device.

5. The image forming apparatus according to claim 4, wherein the processor discharges the toner from the developing device by forming the toner image on the photosensitive drum a plurality of times, and puts the toner from the toner cartridge into the developing device.

6. The image forming apparatus according to claim 1, further comprising:

a density sensor that measures a toner ratio density of the developing device, wherein the processor sets a replenishment time for driving a motor that supplies the toner to the developing device based upon the toner ratio density.

7. The image forming apparatus according to claim 1, wherein when ending a printing operation, the processor measures the second environment parameter by using the environment sensor, and updates the end time environment information based upon the measured first environment parameter.

8. The image forming apparatus according to claim 1, wherein the first environment parameter is humidity.

9. The image forming apparatus according to claim 1, wherein the first environment parameter is temperature.

10. The image forming apparatus according to claim 1, wherein the environment sensor measures the first environment parameter outside a housing.

11. A processing method executed by a processor, the method comprising:

measuring a first environment parameter at a current printing;

discharging a toner from a developing device that stores a developer containing the toner and a carrier when a difference between a second environment parameter indicated by end time environment information stored in a memory in advance at an end of a last printing and the measured first environment parameter at the current printing exceeds a predetermined threshold value; and putting the toner into the developing device.

12. The method according to claim 11, further comprising:

storing in the memory end time information indicating the date and time when the printing ends; and discharging the toner stored in the developing device when a difference between the date and time indicated by the end time information and a printing reception date and time exceeds a time threshold value, and when the difference between the second environment parameter indicated by the end time environment information and the first environment parameter measured by the environment sensor exceeds an environment threshold value, putting the toner into the developing device.

13. The method according to claim 12, further comprising:

wherein when ending a printing operation, updating the end time information based upon a data and time when the printing operation is completed.

14. The method according to claim 11, further comprising:

mounting a toner cartridge that stores the toner;

removing the toner adhering to a photosensitive drum; and discharging the toner from the developing device by forming a toner image on the photosensitive drum with the toner of the developing device, and putting the toner from the toner cartridge into the developing device.

15. The method according to claim 14, further comprising:

discharging the toner from the developing device by forming the toner image on the photosensitive drum a plurality of times, and putting the toner from the toner cartridge into the developing device.

16. The method according to claim 11, further comprising:

measuring a toner ratio density of the developing device; and setting a replenishment time for driving a motor that supplies the toner to the developing device based upon the toner ratio density.

17. The method according to claim 11, further comprising:

wherein when ending a printing operation, measuring the second environment parameter by using the environment sensor, and updating the end time environment information based upon the measured first environment parameter.

18. The method according to claim 11, wherein the first environment parameter is humidity.

19. The method according to claim 11, wherein the first environment parameter is temperature.

20. The method according to claim 11, further comprising:

measuring the first environment parameter outside a housing.

* * * * *